US005568773A

United States Patent [19]

Hung

[11] Patent Number: 5,568,773

[45] Date of Patent: Oct. 29, 1996

[54] MULTIFUNCTIONAL COMPUTER DESK

[76] Inventor: Wang-Ho Hung, No. 73, Sec. 1, Yen-Hai Rd., Hsien-Hsi Hsiang, Changhua Hsien, Taiwan

[21] Appl. No.: 504,069

[22] Filed: Jul. 19, 1995

[51] Int. Cl.[6] ..... A47B 83/00; A47B 46/00

[52] U.S. Cl. ..... 108/50; 312/196; 312/223.3; 312/223.6; 312/313

[58] Field of Search ..... 108/50; 312/194, 312/196, 223.1, 223.2, 223.3, 223.6, 265, 195, 231, 258, 265.5, 263, 313

[56] References Cited

U.S. PATENT DOCUMENTS

| | | | |
|---|---|---|---|
| 4,272,136 | 6/1981 | Sengua | 312/223.3 X |
| 5,121,698 | 6/1992 | Kelley | 108/50 X |
| 5,237,935 | 8/1993 | Newhouse et al. | 108/50 |
| 5,272,988 | 12/1993 | Kelley et al. | 108/50 |
| 5,403,082 | 4/1995 | Kramer | 312/223.3 X |
| 5,429,432 | 7/1995 | Johnson | 312/313 X |

FOREIGN PATENT DOCUMENTS

| | | | |
|---|---|---|---|
| 10301 | 4/1980 | European Pat. Off. | 312/223.6 |

*Primary Examiner*—Jose V. Chen
*Assistant Examiner*—Hanh V. Tran
*Attorney, Agent, or Firm*—Beveridge, DeGrandi, Weilacher & Young, L.L.P.

[57] ABSTRACT

A multifunctional computer desk includes a rear board, two lateral boards, a face board, two corner insertion blocks and a pivotable board. A vertical wire channel is formed on an inner rear edge of each lateral board, whereby wires of business machines are placed in the wire channels and extend along a transverse partitioning board and extend out from recesses of the rear board to connect with the business machines on the desk. A small vertical channel is formed beside the wire channel, whereby each end of the longitudinal partitioning board is inserted in the small vertical channel. A transverse insertion groove is formed on a lower edge of the longitudinal partitioning board. One side of the transverse partitioning board is inserted in the groove, while the other side thereof is fitted in a stepped channel of the rear board. Two insertion slots are formed on two sides of the rear board. The corner insertion blocks can be inserted therein and mounted on two corners of the rear board. Each corner insertion block has a projecting post for mounting the pivotable board on the face board above the transverse partitioning board. The pivotable board can be pivoted for checking or adjusting the wires. A telephone stand and a rotary crank arm are inserted in insertion sockets of the insertion blocks and are freely movably spaced from the face board. A transparent cover with a lock seat is pivotally disposed on a keyboard receptacle of the face board.

20 Claims, 4 Drawing Sheets

MULTIFUNCTIONAL COMPUTER DESK

BACKGROUND OF THE INVENTION

The present invention relates to a multifunctional computer desk including a rear board, two lateral boards, a face board, two corner insertion blocks and a pivotable board. A vertical wire channel is formed on an inner rear edge of each lateral board, whereby wires of business machines are placed in the wire channels and extend along a transverse partitioning board and extend out from recesses of the rear board to connect with the business machines on the desk. The wires are hidden in the wire channels so that the appearance of the desk is tidy and pleasing. The pivotable board can be pivoted upward for checking or adjusting the wires. A transparent cover with a lock seat is pivotally disposed on a keyboard receptacle of the face board, whereby the transparent cover can be locked to prevent the keyboard from being unauthorizedly touched. The transparent cover serves as a document rest when pivoted upward. A telephone stand and a rotary crank arm are inserted in insertion sockets of the insertion blocks and are spaced from the face board. A telephone can be placed on the telephone stand and a computer monitor can be placed on a monitor platform of the rotary crank arm. The telephone stand and the monitor platform can be freely moved and used without occupying any area of the face board of the desk. Therefore, the desk can be more efficiently used.

A conventional office desk is widely used in an office nowadays for placing a computer monitor and other relevant peripheral equipment, such as a keyboard, mouse, printer, etc., thereon. The computer monitor and this equipment have considerably large volume and will occupy most of the area of the desk face. Moreover, these pieces of equipment are connected with one another by electrical wires which pass through the desk in a random pattern. Therefore, it is often difficult to comfortably and efficiently work on a jammed office desk without being intervened by the complicated equipment and wires.

SUMMARY OF THE INVENTION

It is therefore a primary object of the present invention to provide an improved multifunctional computer desk in which the wires of all kinds of business machines are hidden in wire channels under the desk so that the appearance of the desk is tidy and pleasing. In addition, a telephone stand and a rotary crank arm with a monitor platform are mounted on the corners of the desk and are spaced from the face thereof. A telephone can be placed on the telephone stand and a computer monitor can be placed on the monitor platform with the telephone stand and the monitor platform freely movable without occupying any area of the face of the desk. Therefore, the desk can be more efficiently used.

The present invention can be best understood through the following description and accompanying drawings, wherein:

DETAILED DESCRIPTION OF THE PREFERRED EMBODIMENT

Figure 1:
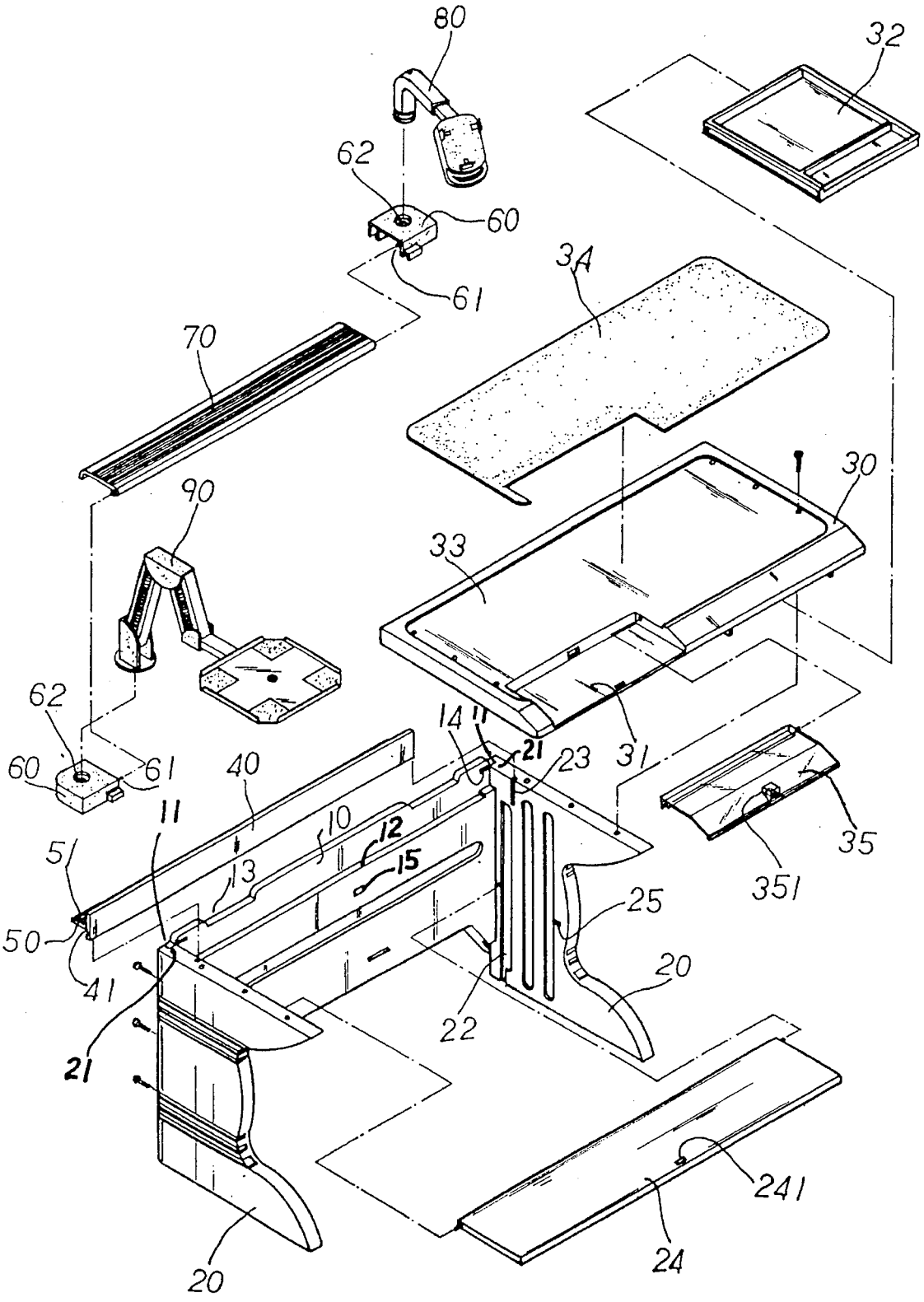
FIG. 1 is a perspective exploded view of the present invention.
Figure 2:
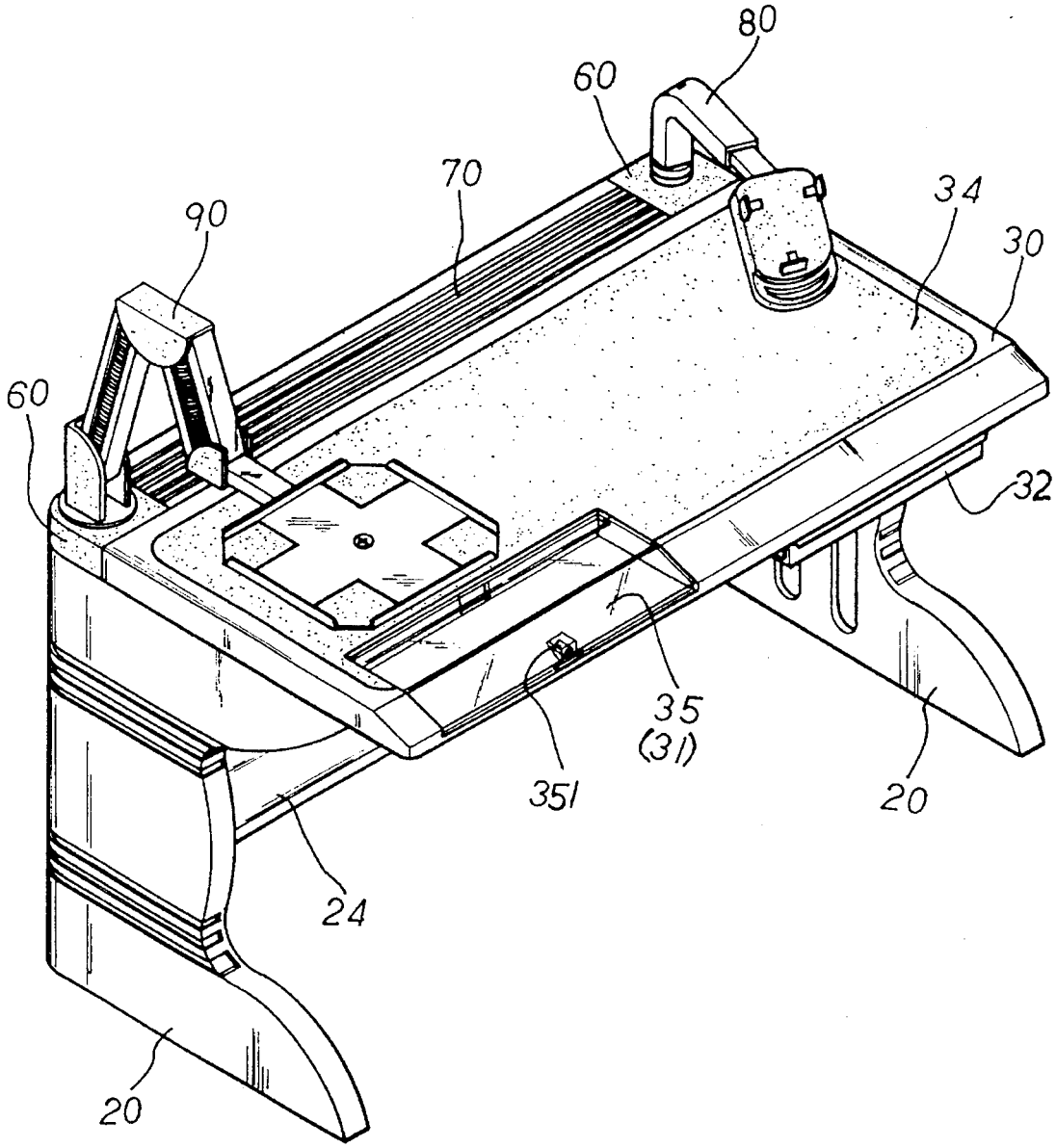
FIG. 2 is a perspective assembled view of the present invention.

Please refer to FIGS. 1 and 2. The present invention includes a rear board 10, two lateral boards 20, a face board 30, a longitudinal partitioning board 40, a transverse partitioning board 50, two corner insertion blocks 60 and a pivotable board 70.

The rear board 10 is formed with stepped channels 11 on two sides for engaging with corresponding stepped channels 21 formed on the rear sides of the lateral boards 20. The two sides of the rear board 10 are formed with thread holes for screws to pass therethrough to lock the rear board 10 with the lateral boards 20. The face board 30 is mounted on the lateral boards 20 by screws. A wider stepped channel 12 is formed on an inner upper edge of the rear board $\mathbf{10}/_R$ and two recesses 13 are formed on two sides thereof. A vertical wire channel 22 is formed on an inner rear edge of each lateral board 20. A small vertical channel 23 is formed beside the wire channel 22, whereby each end of the longitudinal partitioning board 40 is inserted in the small vertical channel 23. A transverse insertion groove 41 is formed on a lower edge of the longitudinal partitioning board 40, whereby one side of the transverse partitioning board 50 is inserted in the groove 41, while the other side thereof is fitted in the wider stepped channel 12 of the rear board 10. Several separating plates 51 are disposed on the transverse partitioning board 50 for guiding the wires.

A support board 24 is pivotably disposed between the lateral boards 20 under the face board 30. The support board 24 can be pivoted upward to attach to the rear board 10 or pivoted downward to be horizontally located on two bosses 25 on the inner surfaces of the lateral boards 20 for placing articles thereon. A magnet 241 is disposed on a front edge of the support board 24 and an iron plate 15 is disposed on the rear board 10 corresponding to the magnet 241, whereby when the support board 24 is pivoted upward, the magnet 241 Will attract the iron plate 15 to fix the support board 24 on the rear board 10.

Two insertion slots 14 are formed on the upper edges of two sides of the rear board 10, whereby the corner insertion blocks 60 can be inserted therein and mounted on the corners of the rear board 10. Each corner insertion block 60 has a projecting post 61 on its inner side for pivotally mounting the pivotable board 70 on the rear side of the face board 30 above the transverse partitioning board 50. Each corner insertion block 60 is formed with an insertion socket 62 for inserting a telephone stand 80 and a rotary crank arm 90 therein. A keyboard receptacle 31 is formed on one side of a front edge of the face board 30 and a drawer 32 is disposed under the other side thereof. A depression 33 is formed on the upper surface of the face board 30 for placing a face decorative board 34 therein. A transparent cover 35 with a lock seat 351 is pivotally disposed on the keyboard receptacle 31, whereby the transparent cover 35 can be locked to prevent the keyboard from being unauthorizedly touched. The transparent cover 35 serves as a document rest when pivoted upward.

Figure 3:
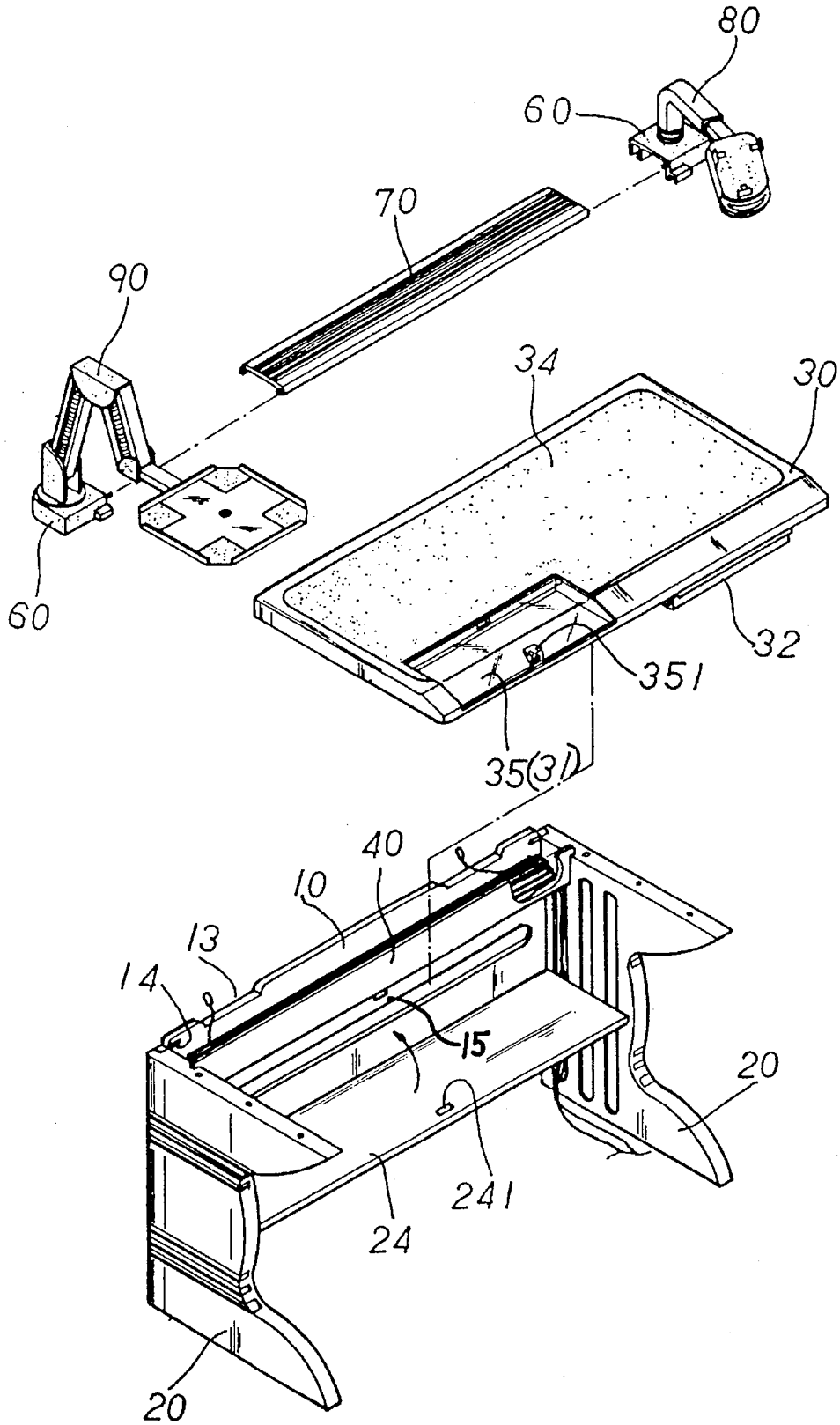
FIG. 3 is a perspective partially exploded view, showing that the wires are hidden in the wires channels of the lateral boards.

Referring to FIG. 3, the wires of the respective business machines can be placed in the wire channels 22 of the lateral boards 20 and extended along the transverse partitioning board 50 and extended out from the recesses 13 of the rear board 10 to connect with the business machines on the desk.

Since the wires are hidden in the wire channels 22, the appearance of the desk is tidy and pleasing. The pivotable board 70 can be pivoted upward for checking or adjusting the wires.

Figure 4:
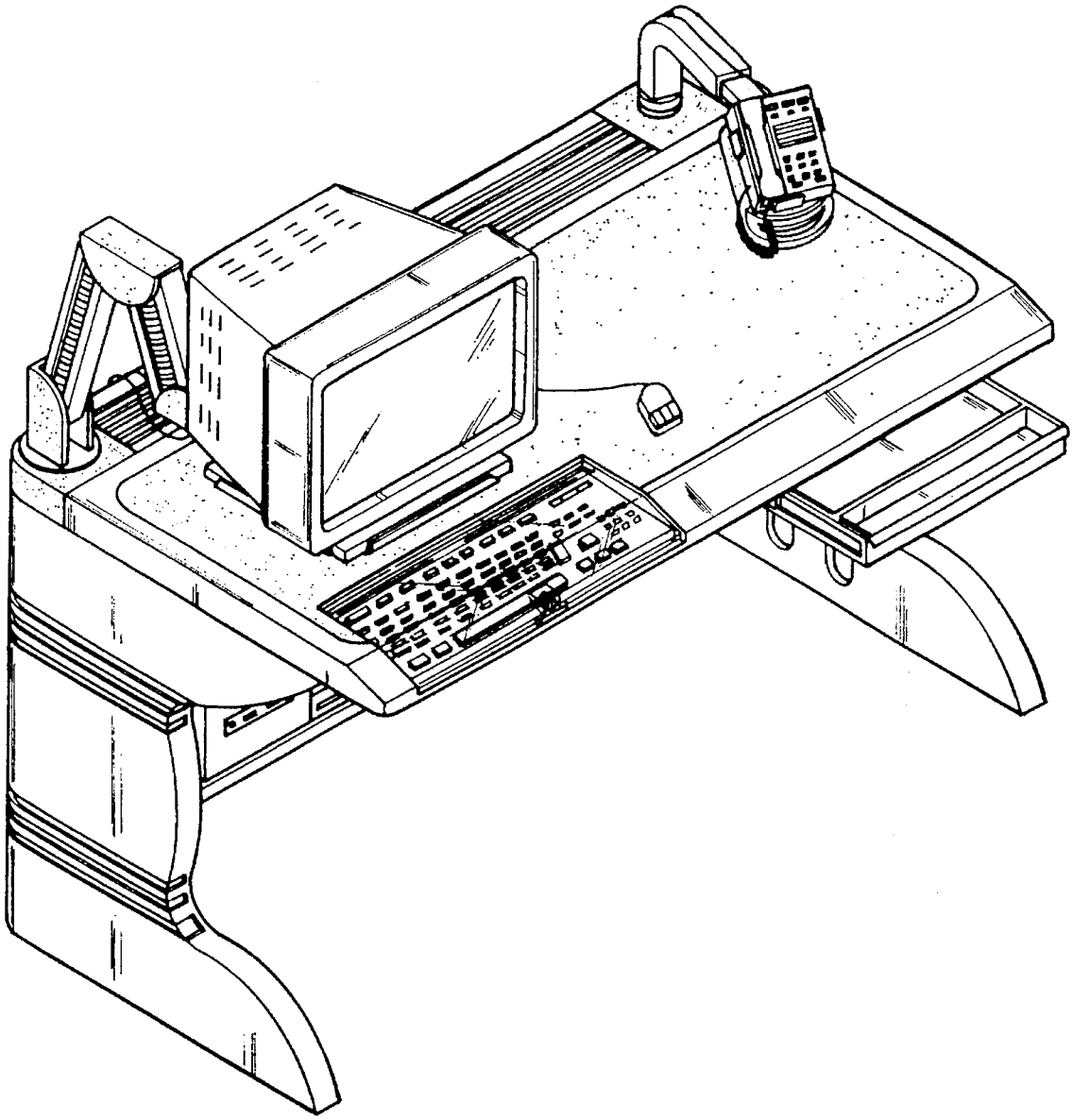
FIG. 4 is a perspective assembled view, showing the application of the present invention.

Referring to FIG. 4, a telephone can be placed on the telephone stand 80 and a computer monitor can be placed on a platform of the rotary crank arm 90. The telephone stand 80 and the rotary crank arm 90 are spaced from the desk face and can be freely moved and used without occupying any area of the desk face. Therefore, the desk can be more efficiently used.

The above embodiment is only an example of the present invention and the scope of the present invention should not be limited to the example. Any modification or variation derived from the example should fall within the scope of the present invention.

What is claimed is:

1. A multifunctional computer desk, comprising a rear board, two lateral boards, a face board, a longitudinal partitioning board, a transverse partitioning board, two corner insertion blocks and a pivotable board, wherein:

the rear board is formed with stepped channels on two sides for engaging with corresponding stepped channels formed on rear sides of the lateral boards, the two sides of the rear board being formed with thread holes for screws to pass therethrough to lock the rear board with the lateral boards, the face board being mounted on the lateral boards by screws, a wider stepped channel being formed on an inner upper edge of the rear board and two recesses being formed on two sides thereof, a vertical wire channel being formed on an inner rear edge of each lateral board, a small vertical channel being formed beside the wire channel, whereby each end of the longitudinal partitioning board is inserted in the small vertical channel, a transverse insertion groove being formed on a lower edge of the longitudinal partitioning board, whereby one side of the transverse partitioning board is inserted in the groove, while the other side thereof is fitted in the wider stepped channel of the rear board, a plurality of separating plates being disposed on the transverse partitioning board for guiding wires of business machines;

a support board is pivotably disposed between the lateral boards under the face board, the support board being pivotable upward to attach to the rear board or pivotable downward to be horizontally located on two bosses on inner surfaces of the lateral boards for placing articles thereon;

two insertion slots are formed on upper edges of two sides of the rear board, whereby the corner insertion blocks can be inserted therein and mounted on two corners of the rear board, each corner insertion block having a projecting post on an inner side for pivotally mounting the pivotable board on a rear side of the face board above the transverse partitioning board, each corner insertion block being formed with an insertion socket for inserting a telephone stand and a rotary crank arm with a platform therein, whereby a telephone and a computer monitor can be placed on the telephone stand and the platform respectively, a keyboard receptacle being formed on one side of a front edge of the face board and a drawer being disposed under the other side thereof, a transparent cover with a lock seat being pivotally disposed on the keyboard receptacle, whereby the transparent cover can be locked to prevent the keyboard from being unauthorizedly touched, the transparent cover serving as a document rest when pivoted upward; and the wires of the business machines are placed in the wire channels of the lateral boards and extend along the transverse partitioning board and extend out from the recesses of the rear board to connect with the business machines on the desk, the pivotable board being pivotable for checking or adjusting the wires, the telephone stand and the rotary crank arm being spaced from the face board of the desk and being freely movable without occupying any area of the face board.

2. A multifunctional desk, comprising:

a rear board, wherein a first side of the rear board has a first stepped channel defined therein, a second side of the rear board has a second stepped channel defined therein, an inner upper edge of the rear board has a wider stepped channel defined therein, and two recesses are defined in the inner upper edge of the rear board;

a first lateral board, wherein a rear side of the first lateral board includes a third stepped channel defined therein for engaging with the first stepped channel of the rear board, a first wire channel is defined in an inner rear edge of the first lateral board, a first vertical channel is defined proximate the first wire channel, and the first vertical channel is small as compared to the first wire channel, wherein the first lateral board further includes a first boss on an inner surface thereof;

a second lateral board, wherein a rear side of the second lateral board includes a fourth stepped channel defined therein for engaging with the second stepped channel of the rear board, a second wire channel is defined in an inner rear edge of the second lateral board, a second vertical channel is defined proximate the second wire channel, and the second vertical channel is small as compared to the second wire channel, wherein the second lateral board further includes a second boss on an inner surface thereof;

a face board mounted on the first lateral board and the second lateral board, wherein a keyboard receptacle is defined on a first side of a front edge of the face board;

a longitudinal partitioning board, wherein a first end of the longitudinal partitioning board is inserted in the first vertical channel of the first lateral board, a second end of the longitudinal partitioning board is inserted in the second vertical channel of the second lateral board, and a transverse insertion groove is defined on a lower edge of the longitudinal partitioning board;

a transverse partitioning board, wherein a first side of the transverse partitioning board is inserted in the transverse insertion groove of the longitudinal partitioning board, a second side of the transverse partitioning board is fit in the wider stepped channel of the rear board, and a plurality of separating plates are disposed on the transverse partitioning board for guiding wires of business machines;

a first corner insertion block for holding a computer monitor platform mounted on the first side of the rear board, wherein an inner side of the first corner insertion block includes a first projecting post;

a second corner insertion block for holding a telephone stand mounted on the second side of the rear board, wherein an inner side of the second corner insertion block includes a second projecting post;

a pivotable board pivotally mounted on the first projecting post and the second projecting post, wherein the pivotable board is located at a rear side of the face board above the transverse partitioning board;

a support board pivotally disposed between the first lateral board and the second lateral board under the face board, the support board being pivotable upward to attach to the rear board or pivotable downward to engage the first boss of the first lateral board and the second boss of the second lateral board;

a drawer provided at a second side of the front edge of the face board; and a cover with a lock seat pivotally disposed over the keyboard receptacle, wherein the cover serves as a document rest when pivoted to an upward position, wherein wires of machines are placed in the first wire channel and the second wire channel and extend along the transverse partitioning board and out from the recesses of the rear board to connect with machines on the desk, the pivotable board being pivotable for checking or adjusting the wires, the telephone stand and the computer monitor platform being spaced from the face board of the desk and being freely movable without occupying any area of the face board.

3. A multifunctional desk according to claim 2, wherein the first side and the second side of the rear board have thread holes defined therein, whereby screws connect the rear board with the first lateral board and the second lateral board.

4. A multifunctional desk according to claim 2, wherein the first corner insertion block includes an insertion socket for receiving a rotary crank arm with the computer monitor platform thereon for holding a computer monitor.

5. A multifunctional desk according to claim 2, wherein the second corner insertion block includes an insertion socket for receiving the telephone stand.

6. A multifunctional desk, comprising:

a rear board;

a first lateral board, wherein a rear side of the first lateral board is engaged with the rear board, wherein the first lateral board further includes a first boss on an inner surface thereof;

a second lateral board, wherein a rear side of the second lateral board is engaged with the rear board, wherein the second lateral board further includes a second boss on an inner surface thereof;

a face board engaged with the first lateral board and the second lateral board;

a longitudinal partitioning board, wherein a first end of the longitudinal partitioning board is attached to the first lateral board, and a second end of the longitudinal partitioning board is attached to the second lateral board;

a transverse partitioning board, wherein a first side of the transverse partitioning board connects to the longitudinal partitioning board, and a second side of the transverse partitioning board extends toward the rear board;

a pivotable board pivotally mounted at a rear side of the face board above the transverse partitioning board; and a support board pivotally disposed between the first lateral board and the second lateral board under the face board, the support board being pivotable upward toward the rear board or pivotable downward to engage the first boss of the first lateral board and the second boss of the second lateral board.

7. The multifunctional desk according to claim 6, wherein a first side of the rear board has a first stepped channel defined therein, and a second side of the rear board has a second stepped channel defined therein.

8. The multifunctional desk according to claim 7, wherein the rear side of the first lateral board includes a third stepped channel defined therein for engaging with the first stepped channel of the rear board, and the rear side of the second lateral board includes a fourth stepped channel defined therein for engaging with the second stepped channel of the rear board.

9. The multifunctional desk according to claim 6, wherein a first wire channel is defined in an inner rear edge of the first lateral board.

10. The multifunctional desk according to claim 9, wherein a second wire channel is defined in an inner rear edge of the second lateral board.

11. A multifunctional desk according to claim 6, wherein a first side and a second side of the rear board have thread holes defined therein, whereby screws connect the rear board with the first lateral board and the second lateral board through the thread holes.

12. A multifunctional desk according to claim 6, wherein an inner upper edge of the rear board has a stepped channel defined therein, and the second side of the transverse partitioning board engages the stepped channel.

13. A multifunctional desk according to claim 6, wherein two recesses are defined in an inner upper edge of the rear board.

14. A multifunctional desk according to claim 6, wherein a keyboard receptacle is defined on a front edge of the face board.

15. A multifunctional desk according to claim 14, further including a cover pivotally disposed at the keyboard receptacle, wherein the cover serves as a document rest when pivoted to an upward position.

16. A multifunctional desk according to claim 6, wherein a first corner insertion block is mounted on the rear board.

17. A multifunctional desk according to claim 16, wherein a second corner insertion block is mounted on the rear board.

18. A multifunctional desk according to claim 17, wherein an inner side of the first corner insertion block includes a first projecting post, and an inner side of the second corner insertion block includes a second projecting post, wherein the pivotal board is pivotally mounted on the first projecting post and the second projecting post.

19. A multifunctional desk according to claim 17, wherein the first corner insertion block includes an insertion socket for receiving a rotary crank arm with a platform thereon for holding a computer monitor, and the second corner insertion block includes an insertion socket for receiving a telephone stand.

20. A multifunctional desk according to claim 6, further including a drawer provided at a front edge of the face board.

* * * * *